United States Patent [19]

Sobole

[11] 4,382,773

[45] May 10, 1983

[54] SAFETY IGNITION DEVICE NOTABLY FOR BURNER VALVE

[75] Inventor: Pierre Sobole, Clenay, France

[73] Assignee: Societe Bourguignonne de Mecanique, France

[21] Appl. No.: 154,122

[22] Filed: May 28, 1980

[30] Foreign Application Priority Data

Jun. 5, 1979 [FR] France ..... 79 14276

[51] Int. Cl.[3] ..... F23Q 3/00

[52] U.S. Cl. ..... 431/264; 431/80; 431/254; 431/258; 313/325; 315/227 R; 137/334

[58] Field of Search ..... 431/264, 266, 258, 80, 431/254–256, 142, 74; 313/325; 137/334, 335, 341; 315/227 R

[56] References Cited

U.S. PATENT DOCUMENTS

| | | | |
|---|---|---|---|
| 2,607,406 | 8/1952 | Caparone | 431/80 X |
| 2,720,614 | 10/1955 | Cavins, Jr. | 431/80 X |
| 3,034,571 | 5/1962 | Matthews | 431/80 X |
| 3,449,638 | 6/1969 | Beesch | 431/264 X |
| 3,584,988 | 6/1971 | Hirsbrunner | 431/254 X |
| 3,681,001 | 8/1972 | Potts | 431/264 |
| 3,949,273 | 4/1976 | Santa | 431/264 X |

*Primary Examiner*—Larry Jones

*Attorney, Agent, or Firm*—Robert E. Burns; Emmanuel J. Lobato; Bruce L. Adams

[57] ABSTRACT

This safety ignition device intended notably for controlling the valve through which gaseous fuel is supplied to a burner injector comprises essentially built-in means for protecting the circuitry from transient overvoltages and current surges, notably a varistor for limiting peak voltages and currents, absorbing disturbing energies and stabilizing pressures.

9 Claims, 4 Drawing Figures

SAFETY IGNITION DEVICE NOTABLY FOR BURNER VALVE

BACKGROUND OF THE INVENTION

The present invention relates to a safety ignition device intended notably for operation in combination with a control valve for burners or heat radiating panels comprising a valve body provided with a gas supply conduit and a recess for a burner, incorporating a valve seat comprising on the one hand a safety body enclosing a magnetic head provided with a winding connected via an electric conductor to a thermocouple and on the other hand a control box enclosing a valve control coil, a gas ignition spark generator, a rectifier, a printed circuit and a grounding lug.

DESCRIPTION OF THE PRIOR ART

Devices of a similar type are well known in the art, but they are objectionable on account of various limitations or inconveniences. Thus, in the first place they may become the source of stray disturbances such as transient overvoltages on the mains supply line, which are then detrimentally transmitted by this line to receivers; as a rule, they comprise scattered, unprotected and unshielded electrical and electronic components connected through cumbersome electrical conductors.

SUMMARY OF THE INVENTION

It is the essential object of the present invention notably to avoid the inconveniences briefly set forth hereinabove which are observed in known ignition devices of this type, by providing an improved ignition device characterized in that it comprises built-in means for protecting them against transient overvoltages, notably in the form of a varistor capable of limiting voltage and current surges, absorbing disturbing energies and stabilizing pressures.

According to another feature characterizing this invention, the means for protecting the device against transient overvoltages or pressure surges, the coil, the rectifier, the igniter of the spark generating unit, the printed circuit and the corresponding connecting leads are enclosed in a control box constituting a compact, fluid-tight and protected overmolded block of insulating material.

In an ignition device of this type, the troubles likely to occur under operating conditions and the possible damages caused by voltage peaks resulting either from the supply current or from a faulty transformer are eliminated up to several thousands volts, thus improving considerably the reliability of the device.

The provision of a rectifier such as a diode bridge provides a current supply for eliminating any vibration while improving the relability of the assembly.

Preferably, the electric section of the device is incorporated in a single overmolded box or case of suitable resin material or other insulating body, which is therefore completely sealed and protected against the ingress of corrosive dust and atmospheres, this box being compact, less cumbersome, easier to use and interchangeable.

By using common component elements for the igniter and the valve remote control means, the cost of the device is reduced appreciably while improving the reliability and simultaneity of the ignition and gas supply functions, the latter being obtained through the valve opening operation.

The number of connections between the control case and of the component elements disposed outside this case is reduced considerably, and this also constitutes an essential factor assisting in improving the reliability of the device.

Other features and advantages of the present invention will appear as the following description proceeds with reference to the accompanying drawings illustrating diagrammatically by way of example two preferred forms of embodiment of the invention.

DESCRIPTION OF THE PREFERRED EMBODIMENTS

Figure 1:
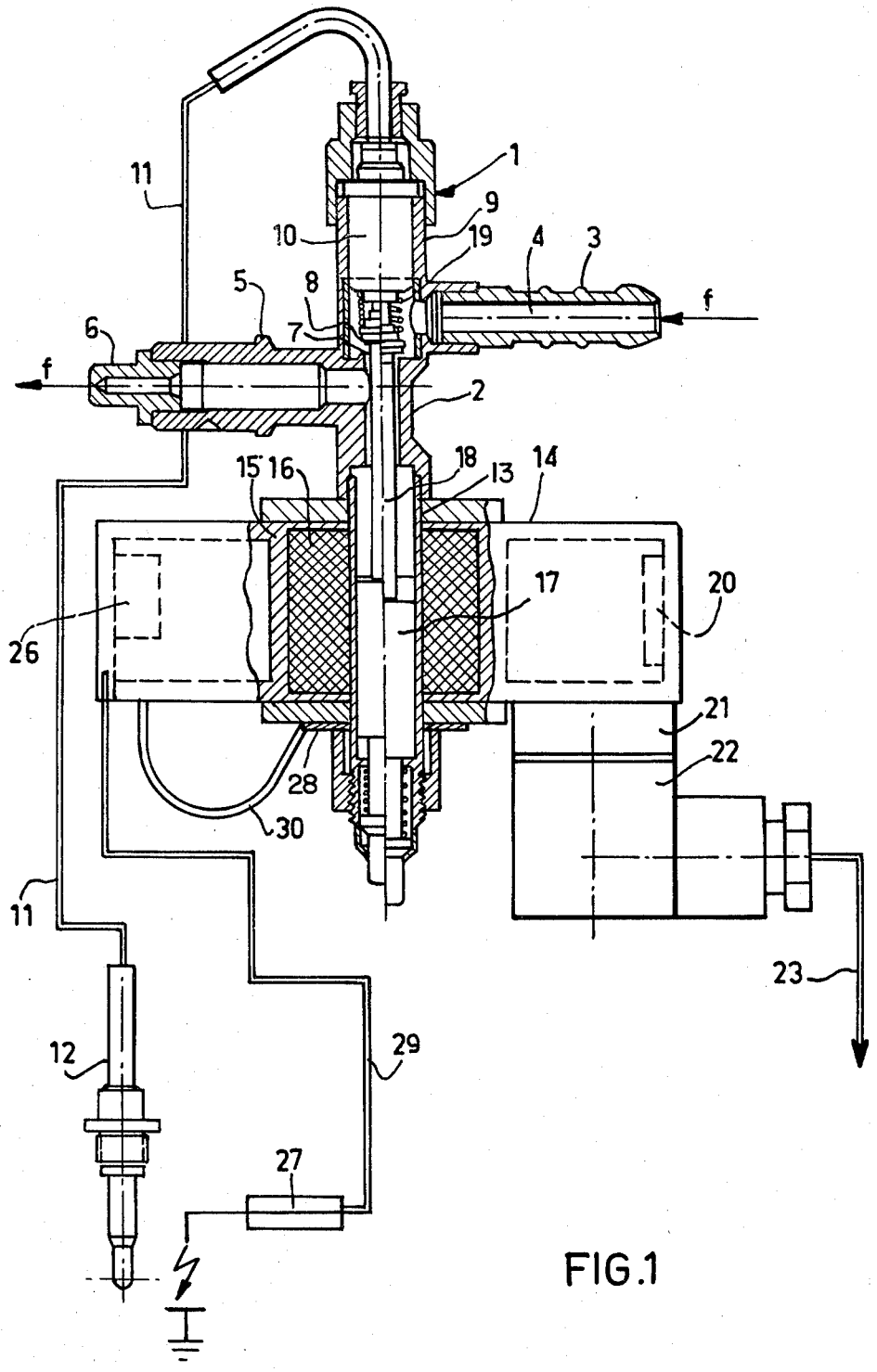
FIG. 1 is a fragmentary diagrammatic view with parts broken away of the device of this invention.

The improved safety ignition device according to this invention shown in FIG. 1 is intended notably for operating in combination with a valve 1, for example for burners or heat-radiating panels, which comprises a rigid valve body 2 provided with an input union 3 constituting the fuel gas supply conduit 4 and an adjacent and opposite recess 5 for a fuel injector 6 which is no part of the present invention.

The valve body 2 comprises a seat 7 for the movable member of a valve 8 interposed in the gas flow between the supply conduit 4 and the injector 6 so as to permit or prevent the passage of gas from said supply conduit 4 to said injector 6 in the direction of the arrows f.

The valve body 2 also comprises a hollow safety body 9 adjacent said union 3 and recess 5, which communicates with the inner space of the gas passage and encloses a magnetic head 10 fastened for example by means of a gas-tight nut screwed on the safety body comprising notably a winding of a fixed electromagnet (not shown) connected through electric conductors 11 to a thermocouple 12 which, when brought to a predetermined temperature, causes a micro-current to flow through the winding, this micro-current being however sufficient for holding the valve member 8 away from its seat, thus permitting the communication between the conduit 4 and injector 6.

The thermocouple 12 is disposed according to requirements either across the flame of injector 6 or inside the flame of a burner, or at any other suitable location where temperature may constitute a proper parameter for controlling the operation of injector 6.

Finally, the valve body 2 comprises a hollow push member 13 adjacent the input union 3 and recess 5, of same direction but opposite way as the safety body 9, a control box 14 being secured, preferably detachably, to the end of said hollow push member 13.

This control box 14 encloses a coil 15 having a winding 16 in which a plunger core 17 is slidably mounted, this plunger core 17 bearing against a push rod 18 mounted in turn for axial sliding movement in the push member body with the interposition of guide means and bearing with one end against the plunger core 17 and with the opposite end against the valve member 8, on the side thereof which is opposed to said rod.

When energizing current is supplied to the winding 16 of coil 15, the plunger core 17 therein is moved upwards, as seen in the lefthand half of FIG. 1, thus moving the valve member 8 away from its seat 7 through the medium of push rod 18, against the antagonistic force of spring 19, so that the gas is allowed to flow from conduit 4 to injector 6. In contrast thereto, when the winding 16 is deenergized, the plunger core 17 and push rod 18 are in the positions shown in the right-hand half view of FIG. 1, and thus valve member 8 is resiliently urged for engagement with its seat 7 by spring 19, and the supply of gaseous fuel is discontinued.

Also housed within control box 14 are a current rectifier 20 and a printed circuit or equivalent means for providing the necessary electric connections.

This control box 14 also comprises a weather-tight electric outlet device 21 provided with safety locking means. This outlet device 21 is adapted to be connected to or disconnected from, with all the necessary or regulation safety means, an electric connector 22 also of the weather-tight type and provided with safety locking means and electric current supply conductors 23.

Figure 2:
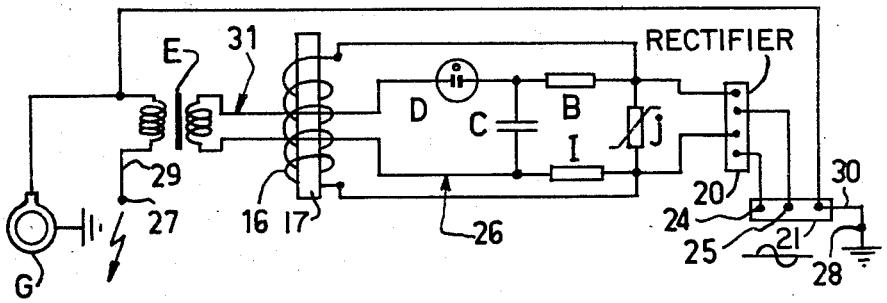
FIG. 2 is a wiring diagram of a first form of embodiment of the device of this invention.
Figure 3:
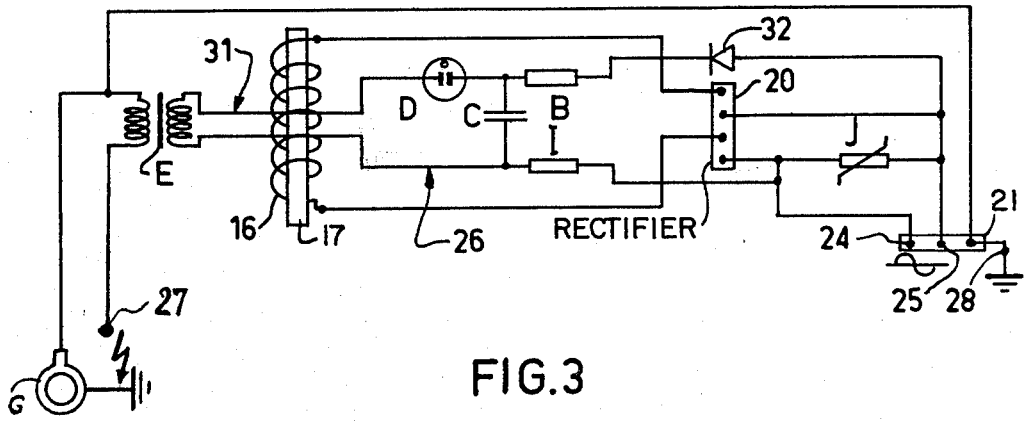
FIG. 3 is a wiring diagram of a second form of embodiment of the device of this invention.

The valve control circuit shown in FIGS. 2 and 3 comprises, in the printed circuit of control box 14, a two-stud inlet 24, 25 for the single-phase alternating current (110 V 60 Hz or 220 V 60 Hz, or the like, from the standard supply mains), notably via a time-lag control member (not shown) and electric supply leads 23.

This inlet is adapted to supply current to the various component elements enclosed in control box 14, namely a rectifier 20 for energizing coil 15 and also an igniter 26 adapted to deliver high-voltage discharge current (for example a 15,000 V-current) to a spark-gap 27 disposed in a gas ignition area. The circuits are advantageously grounded by means of a grounding lug 28.

The electric connection between the igniter 26 enclosed in control box 14 and the spark gap device 27 disposed in a gas ignition area comprises a high-voltage outlet conductor 29. The lug 28 is connected through a grounding lead 30 to the corresponding grounding terminal of the printed circuit within control box 14.

The above-described valve operates as follows:

Assuming that all the component elements of the device are in their inoperative condition, as illustrated in the right-hand half-view of FIG. 1, notably with valve 8 normally engaging its seat 7, the time-lag member, notably in the form of a manually operated or thermostat-responsive switch, a control clock, and a door-opening system or any other similar controlled means, delivers to the device the single-phase current fed through the printed circuit to the rectifier 20 and winding 16 of coil 15. Thus, plunger core 17 is attracted, and this movement is attended concomitantly by that of push rod 18 and therefore of valve member 8 against the force of spring 19 in the direction to open the passage between the gas supply conduit 4 and injector 6.

The rectified current is also supplied via the printed circuit connections to the igniter 26 delivering to spark gap 27 the electric high-voltage discharges necessary for igniting the gas jet from injector 6. Consequently, the gas is ignited and the injector becomes operative.

The time-lag control member stops the delivery of single-phase ignition control current after a relatively short time sufficient however to raise the temperature of thermocouple 12 to a value causing this thermocouple to deliver to the magnetic head 10 the current necessary for holding the valve member 8 in its open position.

The device is responsive to the control action of thermocouple until a failure or other abnormal conditions arise and stop the gaseous fuel combustion, so that the thermocouple 12 will cool down, magnetic head 10 will be deenergized and valve 8 will be reclosed.

The electric circuitry of the device according to the present invention as shown in FIGS. 2 and 3 of the drawings comprise, more particularly, the above-mentioned rectifier 20 (and the a.c. supply means associated therewith) for delivering rectified current in parallel, in the form of embodiment shown in FIG. 1, on the one hand to winding 16 of coil 15 and on the other hand to a high-voltage spark generating unit 31, according to any suitable method and device.

The rectifier 20 may be selected among a wide range of devices of this kind, notably but not exclusively the one comprising four staggered, bridge-forming diodes, this arrangement being advantageous notably in that the rectified power is higher than that obtained by using a single diode, thus avoiding any untimely vibration of the rectifier with respect to a coil or relay. However, the spark generating unit 31 may comprise for example the circuitry shown by way of illustration in the drawings, which incorporates:

a resistor B, notably a varistor or any other component or assembly having the same function, i.e. having a variable resistivity which is high for a voltage lower than or equal or close to the normal supply voltage, and decreases notably very strongly for a voltage rising above said normal supply voltage, even during a very short time period;

a capacitor C or any other assembly or component serving the same purpose;

a gas diode D or any other assembly or component serving the same purpose, i.e. producing a periodic or cyclic discharge of capacitor C into the primary of a transformer E, and the transformer E or any other assembly or component serving the same purpose, i.e. amplifying the discharge voltage of capacitor C, constituting together and in combination said igniter 26, and the spark gap device 27 also used in combination with the igniter, or any other component or assembly serving the same purpose, i.e. generating high-voltage sparks, and incorporating a grounding element G.

Furthermore, the electric circuitry according to the present invention comprises built-in means for protecting the system against transient overpressures, consisting preferably but not exclusively of a varistor J or any other member or assembly providing the same function, i.e. limiting voltage and current surges, absorbing disturbing energies and stabilizing pressures, irrespective of their specific nature. Associated with this varistor J is a resistor I of lower value than resistor B, or any other member or assembly providing the same function, i.e. on the one hand not interfering with the operation of capacitor C and on the other hand capable of attenuating feedback voltage peaks of the primary of transformer E.

According to a first form of embodiment illustrated in FIG. 2, the varistor J is located downstream of rectifier 20 and in parallel on the one hand with coil 15 and on the other hand with igniter 26, notably on the primary of transformer E.

According to another form of embodiment illustrated in FIG. 3, the output of rectifier 20 is not fed directly to coil 15. The spark generating assembly 31 is supplied with rectified current through a spark diode 32.

In this second form of embodiment of the invention the varistor J is disposed upstream of rectifier 20 in order to protect the two circuits to which rectified current is supplied separately.

It will be seen that with the arrangement of the present invention all the component elements, electrical and electronic assemblies or units, such as notably coil 15, rectifier 20, igniter 26, printed circuit and the relevant connections (except for the spark gap device 27 and grounding lug 28) can be housed inside the control box 14, notably in the form of a unitary block of overmolded resin or plastic material or any other suitable insulating, compact, fluid-tight body protected against weather conditions, dust or other noxious or corrosive atmospheres. In this specific form of embodiment, the external connections consist simply of the leads 11 of thermocouple 12, supply line 23, high-voltage conductor 29 and grounding conductor 30.

Figure 4:
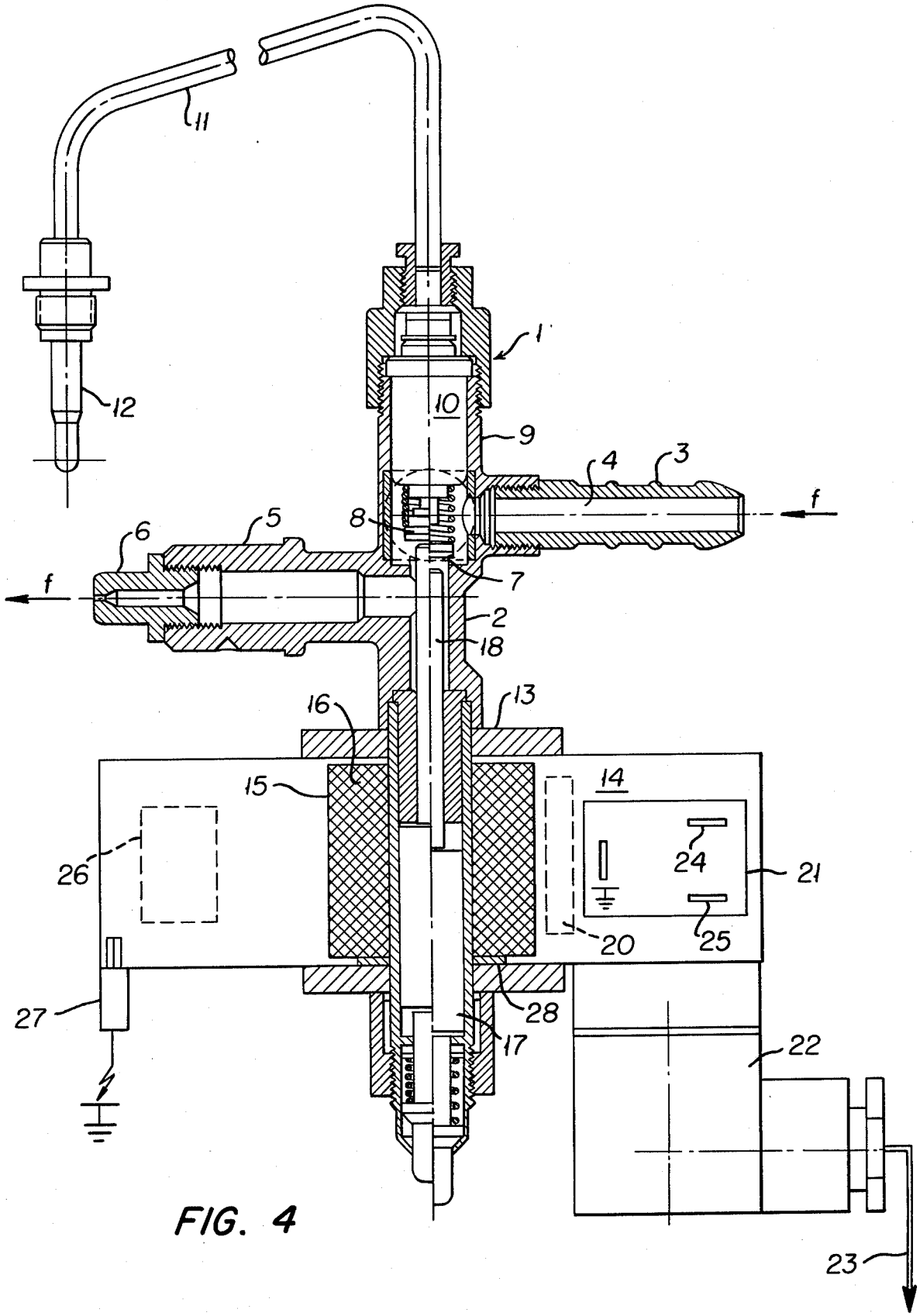
FIG. 4 is a diagrammatic view similar to FIG. 1 but showing a modification.

With this arrangement it is also possible, if necessary and under certain specific conditions, to dispense with said external connections, except for the current supply leads 23, notably by incorporating the spark gap unit 27 in the control box 14 and integrating the grounding lug 28 in the magnetic circuit of coil 15 as illustrated in FIG. 4.

Without further analysis, the foregoing will so fully reveal the gist of the present invention that others can by applying current knowledge readily adapt it for the various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new is:

1. A safety ignition device for operation in combination with a valve for a gaseous fuel burner, comprising an elongate valve body having an axial bore, a gaseous fuel supply conduit opening into said bore, a fuel injector recess opening into said bore at a location spaced from said fuel supply conduit, an annular valve seat in said bore between said fuel supply conduit and said fuel injector recess, a valve member movable in said bore between a closed position in which it is seated on said valve seat and an open position in which it is unseated to permit flow of fuel from said fuel supply conduit to said fuel injection recess, means biasing said valve member to closed position, a thermocouple in position to be heated by said burner, a magnetic head at one end of said valve body and operable on said valve member when energized to hold said valve member in open position, means connecting said magnetic head with said thermocouple to be energized when said thermocouple is heated by said burner, a control box at the opposite end of said valve body, a magnetic coil in said control box coaxial with said valve body box, a plunger core movable axially in said magnetic coil, force transmitting means between said plunger core and said valve member to move said valve member to open position when said magnetic coil is energized, and electric circuitry sealed in said control box comprising gas ignition spark generating means and means for energizing said magnetic coil and said ignition spark generating means, including rectifying means, means for supplying alternating current to said rectifying means, a grounding lug and means for protecting said circuitry against transient voltage surges and for stabilizing the pressure, said protecting means comprising a varistor connected in circuit with said rectifying means.

2. A safety ignition device according to claim 1, in which said ignition spark generating means comprises a transformer having a secondary connected to a spark gap and a primary, two lines connecting the primary of said transformer with said rectifying means, a gas diode and a resistor in one of said lines and a capacitor connected between said lines at a location between said gas diode and said resistor, said varistor being connected between said lines downstream of said rectifying means.

3. A safety ignition device according to claim 1, in which current for energizing said magnetic coil is supplied by said rectifier means and current to said spark generating means is supplied from said means for supplying alternating current.

4. A safety ignition device according to claim 3, in which said ignition spark generating means comprises a transformer having a secondary connected to a spark gap and a primary, two lines connecting the primary of said transformer with said alternating current supply means, a gas diode, resistor and diode in series in one of said lines and a capacitor connected between said lines at a location between said gas diode and said resistor.

5. A safety ignition device according to claim 3 or claim 4, in which said varistor is located between said rectifying means and said alternating current supply means.

6. A safety ignition device according to claim 3 or claim 4, in which external leads comprise leads connecting said thermocouple with said magnetic means and high voltage conductors connecting the secondary of said transformer with said spark gap.

7. A safety ignition device according to claim 1, in which said control box comprises a compact, fluid-tight and shielded overmolded block of insulating material.

8. A safety ignition device according to claim 7, in which said control box further comprises fluid-tight coupling means for coupling said circuitry with standard electric current supply means and fluid-tight and safety lockable switch means controlling current from said supply means.

9. A safety ignition device according to claim 7, in which a spark gap device connected with said ignition spark generating means is integrated in said molded block and said grounding lug is incorporated in the circuit of said magnetic coil.

* * * * *